US006755674B2

(12) United States Patent
Fujii et al.

(10) Patent No.: US 6,755,674 B2
(45) Date of Patent: Jun. 29, 2004

(54) CONNECTOR PROVIDED WITH A WIRE COVER AND A CONNECTOR ASSEMBLY

(75) Inventors: Masayasu Fujii, Yokkaichi (JP); Hitoshi Okumara, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/421,009

(22) Filed: Apr. 22, 2003

(65) Prior Publication Data

US 2003/0199185 A1 Oct. 23, 2003

(30) Foreign Application Priority Data

Apr. 22, 2002 (JP) ..... 2002-118960

(51) Int. Cl.[7] ..... H01R 13/62
(52) U.S. Cl. ..... 439/157; 439/372
(58) Field of Search ..... 439/157, 372

(56) References Cited

U.S. PATENT DOCUMENTS 5,174,781 A * 12/1992 Muzslay ..... 439/372
5,482,394 A * 1/1996 Shinchi et al. ..... 403/325
5,641,293 A * 6/1997 Tsuji et al. ..... 439/157
5,855,486 A 1/1999 Fukamachi et al.
6,447,312 B1 * 9/2002 Takata ..... 439/157
6,558,176 B1 * 5/2003 Martin et al. ..... 439/157
2003/0109166 A1 * 6/2003 Ookura ..... 439/372

* cited by examiner

*Primary Examiner*—Tho D. Ta
*Assistant Examiner*—Larisa Tsukerman
(74) *Attorney, Agent, or Firm*—Anthony J. Casella; Gerald E. Hespos

(57) ABSTRACT

A connector has first and second housings (10, 20) and a wire cover (30) is mounted to cover the upper surface of the second housing (20). A lever (40) is supported rotatably on the second housing (20) and has cam grooves that engage follower pins (15) on the first housing (10). The two housings (10, 20) are connected by rotating the lever (40) to an end position. During this time, arms (41) of the lever (40) constantly press parts of the wire cover (30) to prevent the wire cover (30) from widening sufficiently to disengage the wire cover (30) from the female housing (20).

10 Claims, 13 Drawing Sheets

CONNECTOR PROVIDED WITH A WIRE COVER AND A CONNECTOR ASSEMBLY

BACKGROUND OF THE INVENTION

1. Field of the Invention

The invention relates to a lever-type connector with a wire cover.

2. Description of the Related Art

U.S. Pat. No. 5,855,486 and FIG. 14 herein show a lever-type connector. With reference to FIG. 14, the connector has a male and female housings 1 and 2 that are connectable with each other. Wires 3 are drawn out through the upper surface of the female housing 2 and a wire cover 4 is mounted on the female housing 2 for covering the wires 3. Locking projections 5 are provided on the outer periphery of the upper surface of the female housing 2 and engage resilient locking pieces 6 at the opening edge of the wire cover 4.

Cam grooves 7 are formed in a lever 8 that is supported rotatably on the male housing 1, and follower pins 9 are provided on the female housing 2. A cam action is developed between the cam grooves 7 and the follower pins 9 as the lever 8 is rotated and the cam action connects the housings 1, 2 together.

The opening edge of the cover 4 can widen due to connect of external matter with the cover 4 or due to a bending or pulling force on the wires 3. Such a deformation of the cover 4 may disengage the locking pieces 6 from the locking projections 5 and may disengage the cover 4 from the female housing 2.

Such a problem has been dealt with by forming the cover 4 of a PBT (polybutylene terephthalate) to increase the rigidity of the cover 4 and to suppress the widening deformation of the opening edge of the cover 4. However, the use of expensive PBT increases production costs, and there is a need for improvement.

The present invention was developed in view of the above problems and an object thereof is to effectively prevent a wire cover from disengaging.

SUMMARY OF THE INVENTION

The invention is directed to a connector with a housing connectable with a mating housing. A wire cover is resiliently mountable on the housing by at least one locking portion for at least partly covering one or more wires drawn out from the housing. An operable member is mountable on the housing. The operable member has cam surface that can interact with a follower on the mating housing. The housing is connectable with and separatable from the mating housing by a cam action of the cam surface and the follower as the operable member is operated. The operable member substantially covers the locking portion between the cover and the housing through substantially the entire movable range of the operable member.

The operable member mounted on the housing prevents the locking portion of the wire cover from widening in a way that could disengage the cover from the housing. Thus, the wire cover need not have a higher rigidity than necessary and can be made of an inexpensive synthetic resin.

The operable member preferably is a rotatable or pivotable lever mountable on the housing. Thus, the two housings are connected with and separated from each other by cam action as the lever is rotated.

The locking portion between the cover and the housing preferably is covered by the lever in the entire rotatable or pivotal range of the lever.

The locking portion for the cover may also serve as a locking portion for holding the operable member at a specified position. Thus, the connector can be constructed simply.

A locking projection on the housing preferably engages both a locking hole of the wire cover and a locking hole of the operable member.

Operable member locking means may be provided on the operable member, the housing and/or the mating housing to lock the operable member in the position where the two housings are connected properly. The operable member locking means may comprise an unlocking guide surface for guiding a disengagement of the locking means when a force of a specified intensity or higher acts to move the housing away from the mating housing and/or acts on the operable member.

The operable member preferably comprises one or more arms, which substantially press the locking portion from outside to prevent the locking portion and/or a portion of the wire cover from widening.

The operable member preferably comprises a pair of arms and an operable portion connecting the arms and the housing is between the arms.

The invention also relates to a connector assembly comprising the above-described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
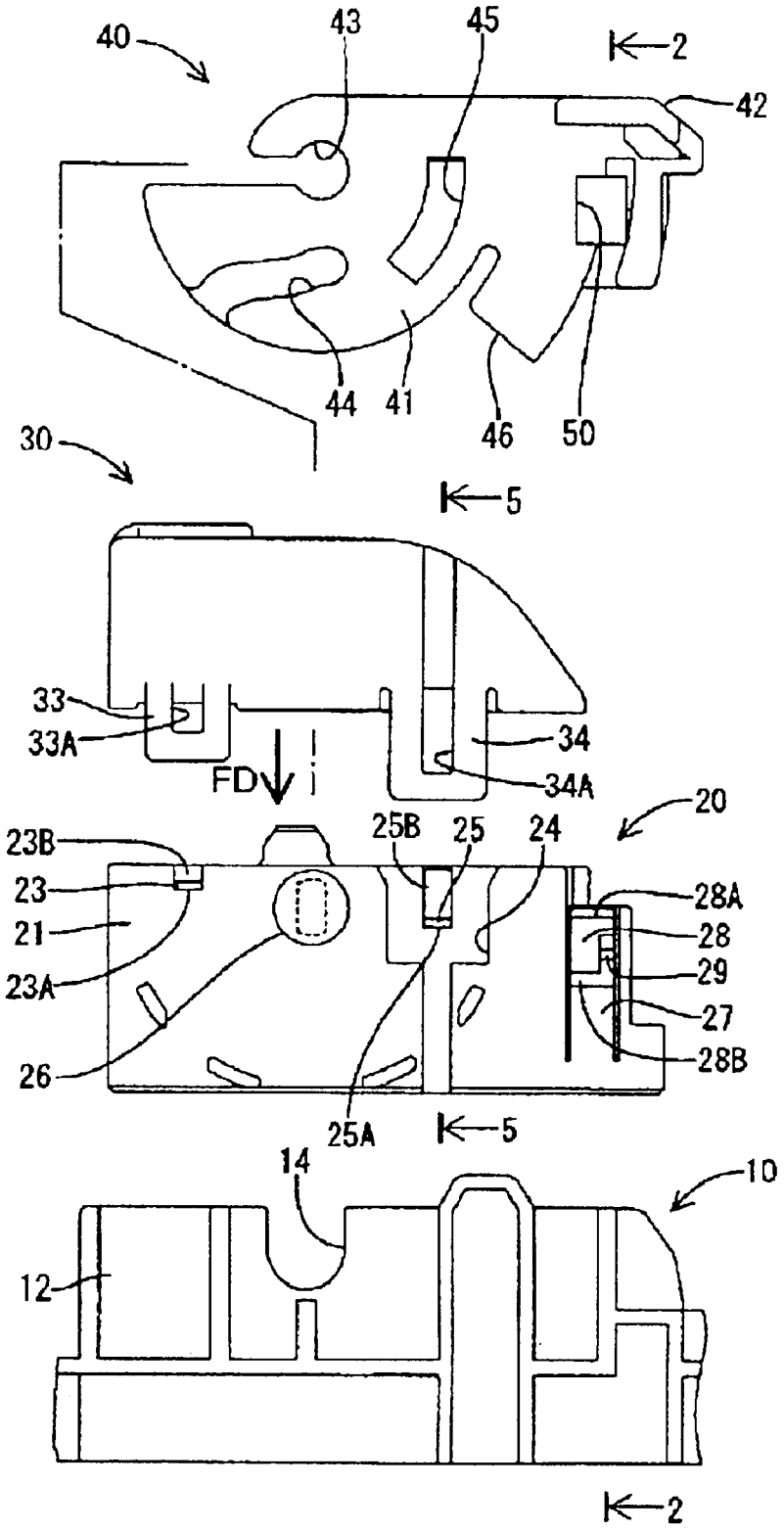
FIG. 1 is an exploded front view of one embodiment of the present invention.
Figure 2:
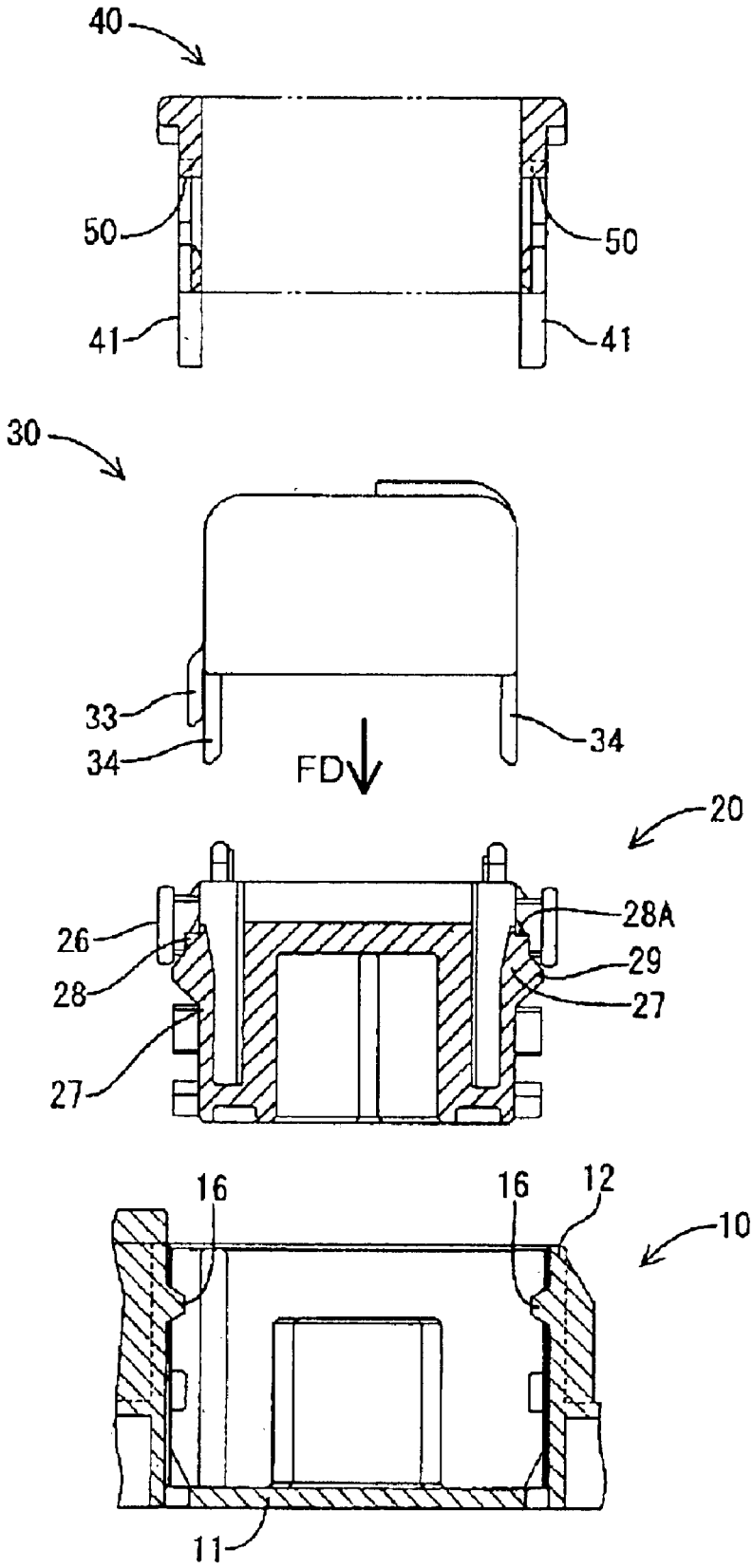
FIG. 2 is a section along 2—2 of FIG. 1.

A connector according to the invention includes a male housing 10, a female housing 20, a wire cover 30 and a lever 40, as shown in FIGS. 1 and 2.

The male housing 10 is formed integrally or unitarily on a device, such as a relay box, or is mounted to such a device.

Figure 3:
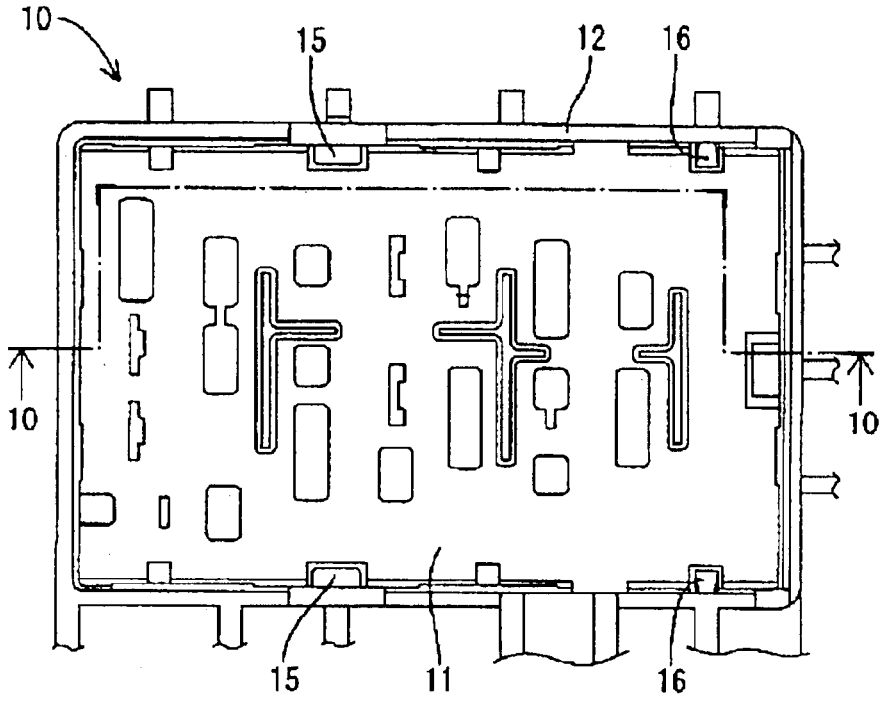
FIG. 3 is a plan view of a male housing.

The male housing 10 has a device main body 11 and a substantially rectangular receptacle 12 that projects from the device main body 11, as shown in FIG. 3. Tab-shaped male terminals (not shown) project from the bottom surface of the male housing 10.

Figure 4:
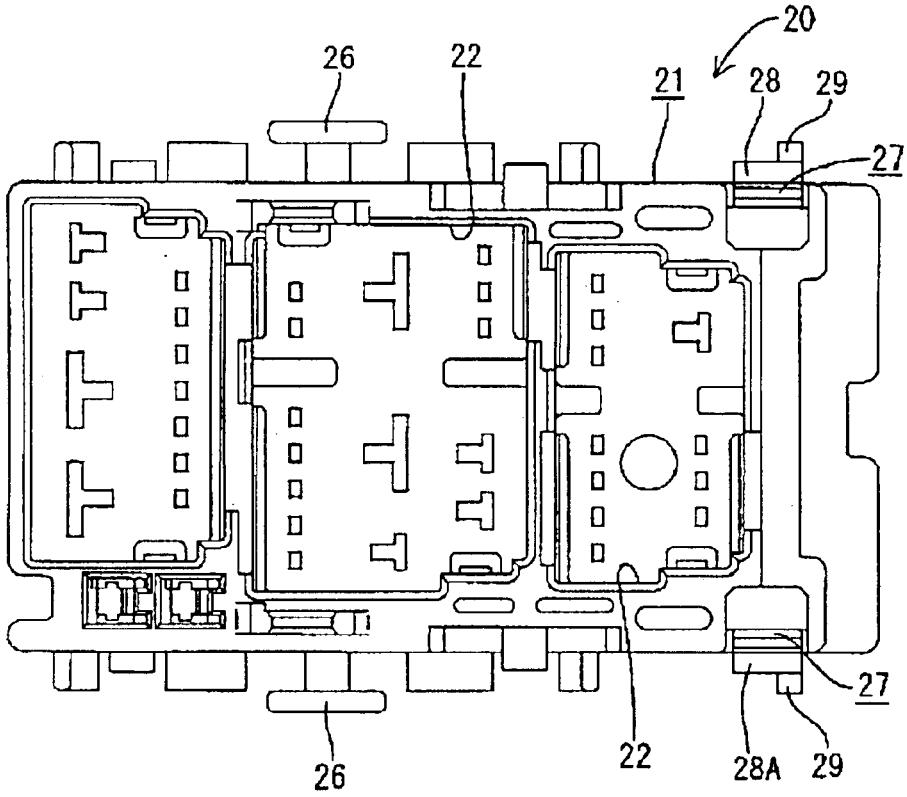
FIG. 4 is a plan view of a female housing.
Figure 8:
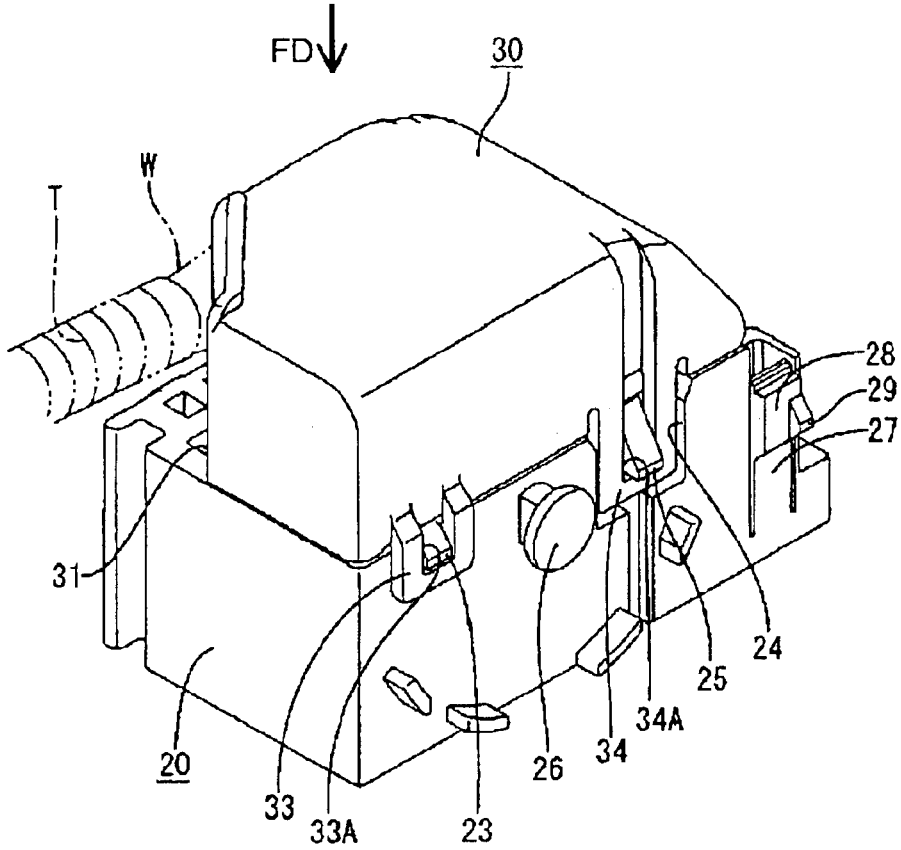
FIG. 8 is a perspective view showing a state where a cover is mounted on the female housing.
Figure 9:
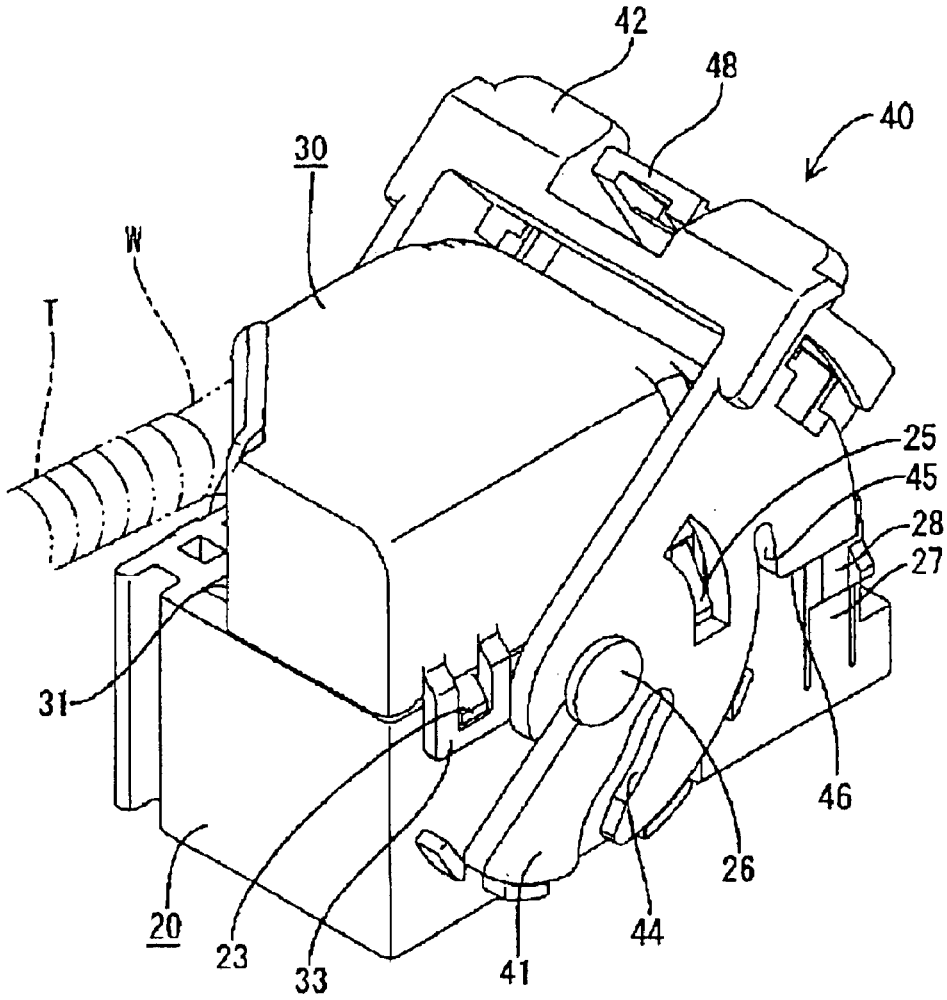
FIG. 9 is a perspective view showing a state where the lever is mounted at an initial position.

The female housing 20 is a split housing that includes a frame 21 and auxiliary housings (not shown). The frame 21 is dimensioned to fit into the male housing 10, and accommodating recesses 22 are formed in the upper surface of the frame 21 as shown in FIG. 4. The auxiliary housings are accommodated respectively in the accommodating recesses 22 and receive female terminals that connect with the male terminals of the male housing 10. Wires W extend from the female terminal fittings and are bundled by winding a tape T as indicated by chain line in FIG. 8. The wires W are drawn out laterally from the back.

The wire cover 30 is mounted on the upper surface of the female housing 20 in a fitting direction FD, and is configured for covering at least part of the drawn-out wires W. The wire cover 30 is made e.g. of a synthetic resin and is substantially in the form of a box that has an open bottom. A lateral side of the wire cover 30, when viewed from front, is slanted, as shown in FIG. 1, to permit rotation of the lever 40. The back left side of the cover 30 is cut obliquely to form a draw-out opening 31 through which the wires W are drawn out (see FIG. 8). Accordingly, the wires W are drawn out from the wire cover 30 substantially normal to the fitting direction FD.

Figure 5:
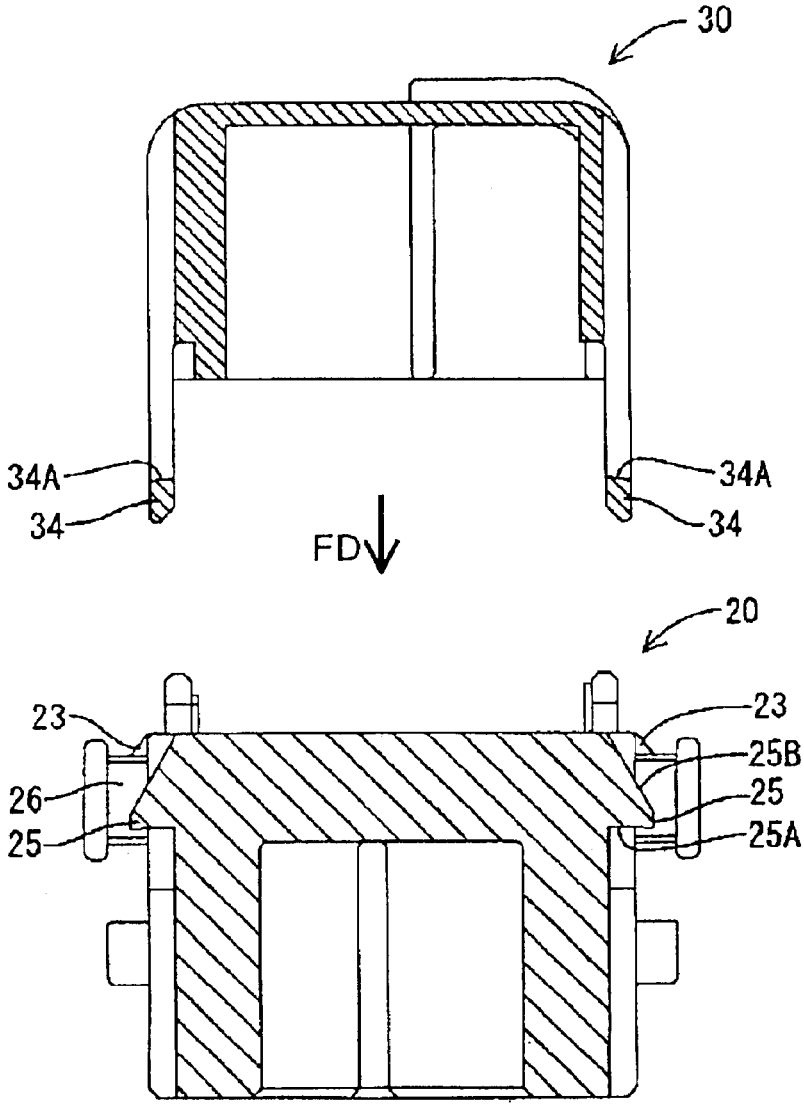
FIG. 5 is a section along 5—5 of FIG. 1.

A short first locking piece 33 is formed at the left side of the wire cover 30 and projects down in the fitting direction FD toward the female housing 20 from the bottom edge of the front surface. The first locking piece 33 bulges out more forward than the front surface, as shown in FIG. 2, and is formed with a locking hole 33A. Second locking pieces 34 are formed at the right side of the wire cover 30 and project down in the fitting direction FD toward the female housing 20 from the bottom edges of the front and rear surfaces, as shown in FIG. 5. Each second locking piece 34 is formed with a locking hole 34A. The second locking pieces 34 are longer than the first locking piece 33 and are substantially flush with the front and rear surfaces of the wire cover 30.

A first locking projection 23 is formed at the upper edge of the front surface at a lateral end of the frame 21. The first locking projection 23 is engageable with the locking hole 33A of the first locking piece 33. A locking surface 23A is formed at the bottom of first locking projection 23 and is substantially normal to the fitting direction FD. However, an oblique guiding surface 23B is formed at the top of the first locking projection 23 and is aligned oblique to the fitting direction FD.

Accommodating grooves 24 are formed at the upper ends of the front and rear surfaces of a right end of the frame 21 to accommodate the respective second locking pieces 34. The accommodated second locking pieces 34 are substantially flush with the front and rear surfaces of the frame 21.

A second locking projection 25 is formed at the upper end of each accommodating groove 24 and is engageable with the locking hole 34A of the respective second locking piece 34. Each second locking projection 25 is longer than the first locking projection 23. A locking surface 25A is formed at the bottom of each second locking projection 25 and is substantially normal to the fitting direction FD. A guiding surface 25B is formed at the top of the second locking projection 25 and is aligned oblique to the fitting direction FD. The height of each second locking projection 25 is about twice the height of the first locking projection 23, and the tops thereof are at substantially the same height as the first locking projection 23 despite the fact that they project from the bottoms of the accommodating grooves 24.

The second locking pieces 34 can be accommodated in the accommodating grooves 24 to be flush with the front and rear surfaces of the frame 21. Simultaneously, the bases of the second locking projections 25 engage the corresponding locking holes 34A and the leading ends of the second locking projections 25 project from the outer surfaces of the second locking pieces 34.

Figure 6:
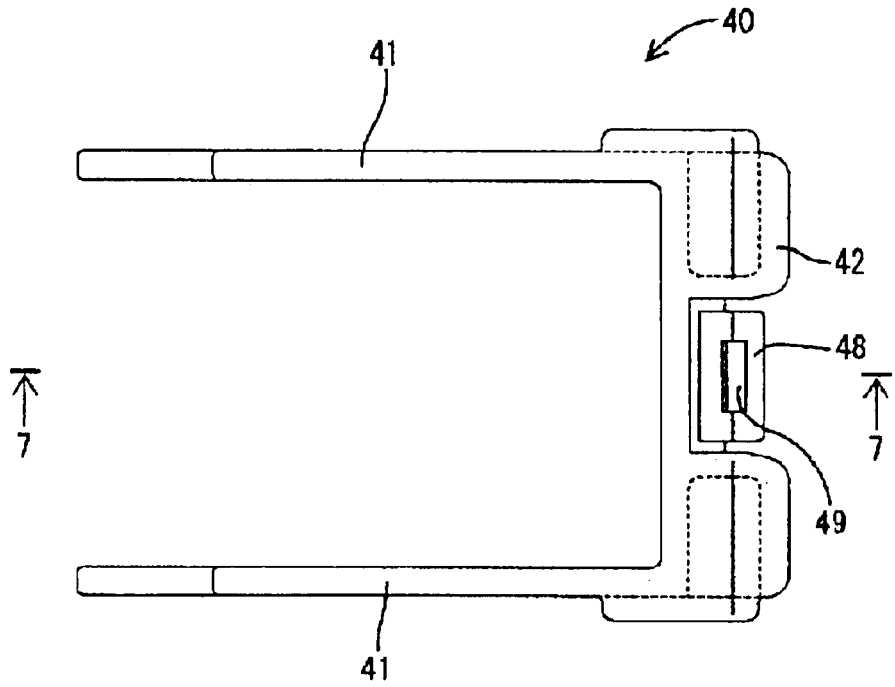
FIG. 6 is a plan view of a lever.
Figure 7:
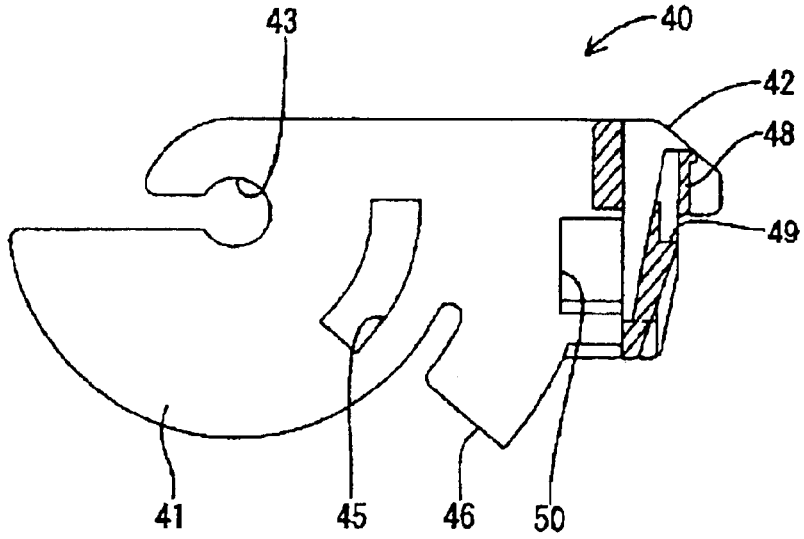
FIG. 7 is a section along 7—7 of FIG. 6.
Figure 13:
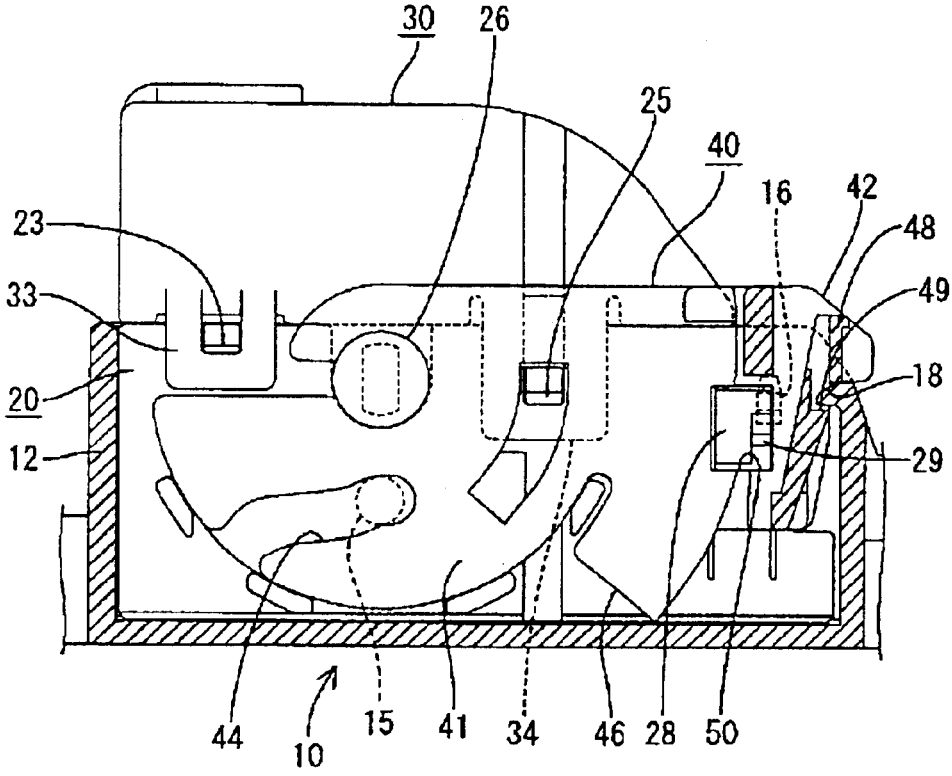
FIG. 13 is a front view partly in section showing a state reached by rotating the lever to an end position.
Figure 14:
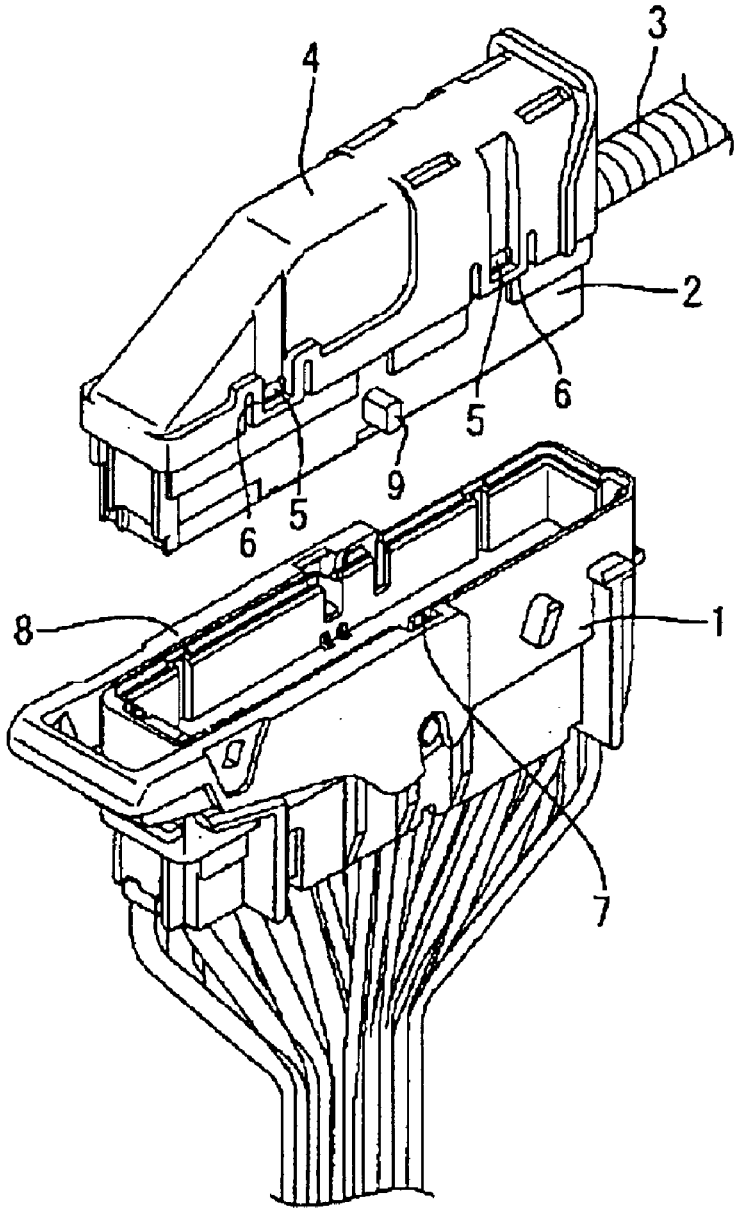
FIG. 14 PRIOR ART
FIG. 14 is a perspective view of a prior art connector.

The lever 40 is made e.g. of a synthetic resin and is mounted on the female housing 20. The lever 40 is substantially U-shaped, and includes two substantially plate-shaped arms 41 that are coupled by an operable portion 42 as shown in FIGS. 6 and 7. Each arm 41 has a shaft hole 43 and a cam groove 44. The lever 40 is mounted to cross over the female housing 20 and is supported pivotably by engaging the shaft holes 43 with shafts 26 formed on the front and rear surfaces of the frame 21. The lever 40 is pivotable between an initial position where the lever 40 is oblique to the fitting direction FD, as shown in FIG. 10, and an end position where the lever 40 is substantially normal to the fitting direction FD, as shown in FIG. 13.

Figure 10:
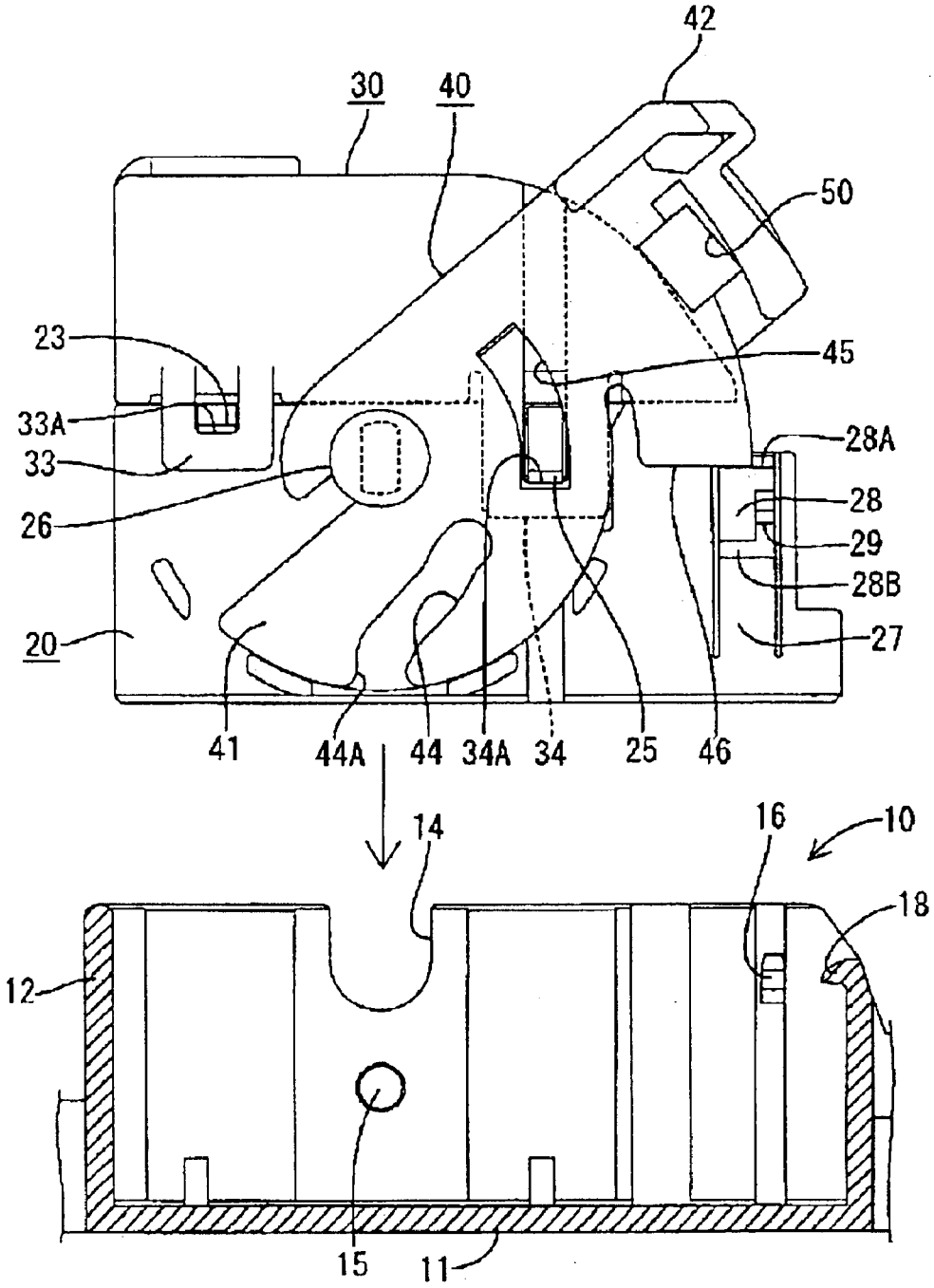
FIG. 10 is a section along 10—10 of FIG. 3 showing a state before the female housing is connected.

Escaping slots 14 are formed in the front and rear plates of the receptacle 12 of the male housing 10, as shown in FIG. 10, and receive the shafts 26 of the female housing 20. A follower pin 15 projects at a position on the inner surface of each of the front and rear plates below the escaping slot 14 for engaging the corresponding cam groove 44 of the lever 40.

An arc-shaped partial locking groove 45 is formed on each arm 41 of the lever 40 and is centered on the shaft hole 43 of each arm 41 at locations slightly displaced toward the base end. The projecting end of the corresponding second locking projection 25 is fittable into the partial locking groove 45.

A contact plate 46 bulges out at a side of each arm 41 and is located more toward the base end than the partial locking groove 45. A locking plate 27 projects up toward the lever 40 at each of the front and rear surfaces of the right side of the frame 21 of the female housing 20, and the upper end of the locking plate 27 is resiliently deformable in and out. A locking step 28 projects from the outer surface of the upper end of each locking plate 27. A locking surface 28A is formed on the upper end of the locking step 28 and is aligned substantially normal to a moving direction of the lever 40. A slanted guiding surface 28B is formed on the bottom surface of the locking step 28.

The projecting ends of the second locking projections 25 fit into the partial locking grooves 45 and engage the bottom edges of the partial locking grooves 45, as shown in FIG. 10, when the lever 40 is mounted on the female housing 20. Thus, rotation of the lever 40 from the initial position in a counterclockwise direction in FIG. 10 and away from the end position is prevented. Further, clockwise rotation of the lever 40 from the initial position toward the end position is prevented temporarily by the engagement of the contact plates 46 with the locking surfaces 28A of the locking steps 28 of the locking plates 27. As a result, entrances 44A of the cam grooves 44 in the lever 40 face substantially straight down toward the male housing 10.

A pushable projection 29 is formed at a right bottom position of FIG. 10 on the outer surface of the locking step 28 of each locking plate 27 and has a substantially triangular cross section with slanted upper and lower surfaces. The lower slanted surface is substantially continuous with the guiding surface 28B of the locking step 28.

A disengaging portion 16 is formed near the right end on the inner surface of each of the front and rear plates of the receptacle 12 of the male housing 10, as shown in FIG. 2, and is engageable with the corresponding pushable projection 29. The disengaging portions 16 have a substantially triangular cross section with slanted upper and lower surfaces. The disengaging portions 16 can move onto the pushable projections 29 when the female housing 20 is connected with the male housing 10 and the follower pins 15 substantially face the entrances 44A of the cam grooves 44.

A lock arm 48 is provided at a longitudinal middle of the operable portion 42 of the lever 40, as shown in FIGS. 6 and 7, and is resiliently deformable about its bottom end in a substantially radial direction with respect to the shaft hole 43. The lock arm 48 has a lock hole 49 and is engageable with a hook 18 at the upper end of the right side plate of the receptacle 12 of the male housing 10, as shown in FIG. 10. The hook 18 engages the lock hole 49 to prevent the lever 40 from returning from the end position shown in FIG. 13 to the initial position.

Each arm 41 of the lever 40 is formed with an escaping hole 50 into which the locking step 28 of the corresponding locking plate 27 including the pushable projection 29 can fit when the lever 40 is at the end position.

The female housing 20 is assembled by first inserting the auxiliary housings into the accommodating recesses 22 of the frame 21. The wires W extending from the respective female terminal fittings then are bundled and wound by the tape T and are drawn out substantially normal to the fitting direction FD.

The wire cover 30 then is mounted on the upper surface of the female housing 20 in the fitting direction FD. As a result, the first locking piece 33 moves onto the guiding surface 23B of the first locking projection 23 and deforms resiliently. Additionally, the second locking pieces 34 move onto the guiding surfaces 25B of the second locking projections 25 and deform resiliently.

The wire cover 30 is pushed in the fitting direction FD until the bottom opening edge contacts the outer periphery of the upper surface of the female housing 20. Thus, the first locking projection 23 fits into the locking hole 33A and the first locking piece 33 restores into the position shown in FIG. 8. Additionally, both second locking pieces 34 are restored and fit into the accommodating grooves 24. Thus, the second locking pieces 34 are substantially flush with the front and rear surfaces of the frame 21, and the base sides of the second locking projections 25 fit in the locking holes 34A. In this way, the wire cover 30 is mounted on the upper surface of the female housing 20, and the bundled wires W are drawn out through the draw-out opening 31.

The shaft holes 43 of the arms 41 of the lever 40 then are mounted pivotally on the shafts 26 of the female housing 20 and the lever 40 is pivoted to the initial position. As a result, the projecting ends of the second locking projections 25 engage the bottom ends of the partial locking grooves 45 and the contact plates 46 contact the locking steps 28 of the locking plates 27. Thus, the lever 40 is held at the initial position and is prevented from pivoting in any direction. At this time, the entrances 44A of the cam grooves 44 face down toward the mating side with the male housing 10.

Areas of the arms 41 of the lever 40 that have the partial locking grooves 45 press the second locking pieces 34 from outside, as shown in FIG. 10, and prevent the bottom opening of the wire cover 30 from widening.

The female housing 20 then is connected with the male housing 10 from the mating side as indicated by an arrow of FIG. 10. As a result, the follower pins 15 of the male housing 10 face the entrances 44A of the cam grooves 44, as shown in the FIG. 11. The disengaging portions 16 of the male housing 10 move onto the pushable projections 29 of the locking plates 27. Accordingly, the locking plates 27 deform resiliently in and the locking steps 28 disengage from the contact plates 46. The lever 40 then is permitted to pivot toward the end position (in clockwise direction of FIG. 11).

Figure 12:
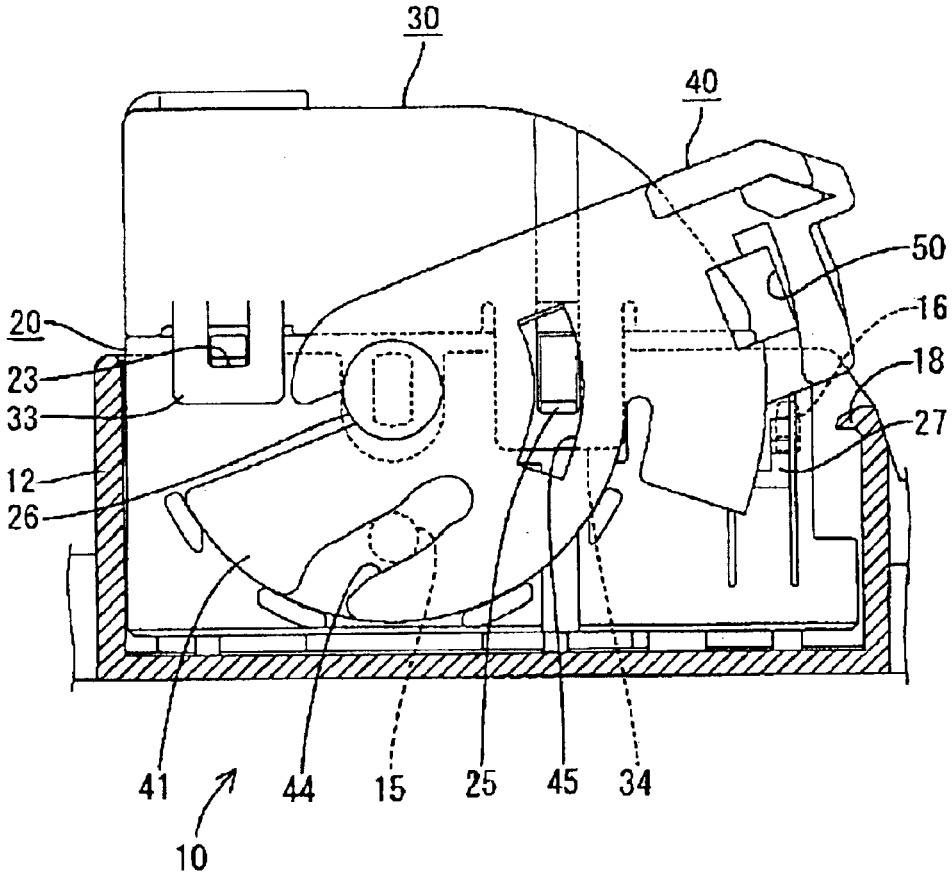
FIG. 12 is a front view partly in section showing an intermediate stage of rotation of the lever.

The cam action of the cam grooves 44 and the follower pins 15 pulls the female housing 20 into the male housing 10 with a low connecting force when the lever 40 is pivoted as shown in FIG. 12.

The lever 40 is pivoted further toward the end position while the lock arm 48 is deformed. The lever 40 is pivoted substantially to the end position where the bottom surface of the frame 21 of the female housing 20 contacts the bottom surface of the male housing 10 as shown in FIG. 13. As a result, the lock arm 48 is restored and the hook 18 is fit into the lock hole 49 to prevent the lever 40 from returning toward the initial position. Further, the disengaging portions 16 escape upward of the pushable projections 29, and the locking steps 28 escape into the escaping holes 50 while the locking plates 27 are restored. In such a state, the male and female housings 10, 20 are locked in their properly connected state.

During this time, the areas of the lock arms 41 of the lever 40 where the partial locking grooves 45 are formed keep pressing the second locking pieces 34 from outside and the wire cover 20 is likewise kept prevented from undergoing a widening deformation.

The housings 10, 20 may require separation for maintenance or other reason. Separation is achieved by pushing the upper end of the lock arm 48 in toward the shaft hole 43. Thus, the lock arm 48 is deformed resiliently to the state shown in FIG. 13 to disengage the lock arm 48 from the hook 18. The slanted guiding surfaces 28B of the locking steps 28 define a semi-locking construction. As a result, the lever 40 can pivot counterclockwise in FIG. 13 toward the initial position. As a result, the locking plates 27 deform and the female housing 20 is pulled gradually out of the male housing 10 by the cam action of the cam grooves 45 and the follower pins 15. During this time, the disengaging portions 16 move onto the pushable projections 29 from the opposite side to cause the locking plates 27 to deform further.

Figure 11:
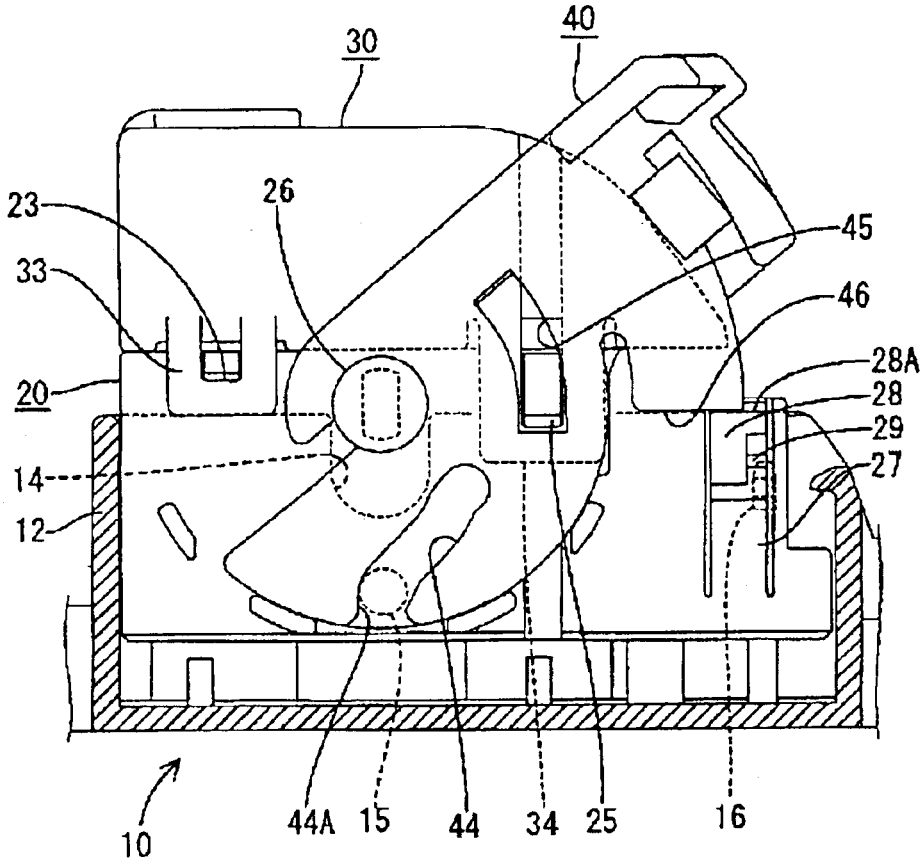
FIG. 11 is a front view partly in section showing an initial stage of connection of the male and female housings.

As shown in FIG. 11, the follower pins 15 return to the entrances 44A of the cam grooves 44 when the lever 40 is pivoted to the initial position where the second locking projection 25 contacts the bottom edge of the partial locking groove 45. Thus, the female housing 20 can be separated from the male housing 10 by being pulled up. During this time, the disengaging portions 16 move into a position below the pushable projections 29. As a result, the locking plates 27 restore and the locking surfaces 28A of the locking steps 28 engage the contact plates 46. Thus, the lever 40 is held at the initial position again.

As described above, areas of the lock arms 41 of the lever 40 that have the partial locking grooves 45 constantly cover and press the second locking pieces 34 from a stage before the female housing 20 is connected with the male housing 10 to a state where the male and female housings 10, 20 are connected properly. Thus, the bottom opening of the wire cover 30 is prevented from widening in a manner that would disengage the wire cover 30 from the female housing 20. Therefore, the wire cover 30 does not have a higher rigidity than necessary and can be made of an inexpensive synthetic resin material such as a PP (polypropylene). As a result, production costs can be reduced.

The second locking projections 25 on the female housing 20 are used as a common locking portion to mount the wire cover 30 and to hold the lever 40 at the initial position. Thus, the connector can be constructed simply.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

A locking means for holding the lever at the initial position may be provided separately from the one for holding the wire cover onto the housing.

Depending on the shape of the housings, the wire cover and the lever may be mounted on the male housing converse to the foregoing embodiment.

What is claimed is:

1. A connector, comprising:

a housing (20) connectable with a mating housing (10), the mating housing (10) having a cam follower (15);

an operable member (40) mountable on the housing (20) and having a cam surface (44) configured for interacting with the cam follower (15) on the mating housing (10), the housing (20) being connectable with and separatable from the mating housing (10) by a cam action of the cam surface (44) and the follower (15) as the operable member (40) is operated; and a wire cover (30) mountable on the housing (20) by at least one resilient lock (25; 34) for at least partly covering wires (W) drawn from the housing (20), the lock (25; 34) being covered by the operable member (40) through an entire movable range of the operable member (40).

2. The connector of claim 1, wherein the operable member (40) comprises a rotatable lever (40) mountable on the housing (20), the two housings (20, 10) being connected with and separated from each other by cam action as the lever (40) is rotated.

3. The connector of claim 2, wherein the lock (25; 34) between the cover (30) and the housing (20) is covered by the lever (40) in the entire rotatable range of the lever (40).

4. The connector of claim 1, wherein the lock (25; 34) for the cover (30) also locks the operable member (40) at a specified position.

5. The connector of claim 4, wherein a locking projection (25) on the housing (20) is engageable both with a locking hole (34A) in the wire cover (30) and with a locking hole (45) of the operable member (40).

6. The connector of claim 1, wherein an operable member locking means (18; 49) is provided on at least one of the operable member (40), the housing (20) and the mating housing (10) for locking the operable member (40) in a position where the two housings (20, 10) are connected properly.

7. The connector of claim 6, wherein the operable member locking means (28; 46) comprise an unlocking guide surface (28B) for guiding a disengagement of the locking means (28, 46) when a force of at least a specified intensity acts to move the housing (20) away from the mating housing (10).

8. The connector of claim 1, wherein the operable member (40) comprises at least one arm (41) that presses the lock (25; 34) from outside for preventing the lock and a portion of the wire cover (30) from undergoing a widening deformation.

9. The connector of claim 1, wherein the operable member (40) comprises a pair of arms (41) and an operable portion (42) connecting the arms (41), wherein the housing (20) is arranged between the arm portions (41).

10. The connector of claim 1, further comprises a mating connector connectable therewith.

* * * * *

UNITED STATES PATENT AND TRADEMARK OFFICE

CERTIFICATE OF CORRECTION

PATENT NO. : 6,755,674 B2
DATED : June 29, 2004
INVENTOR(S) : Masayasu Fujii et al.

It is certified that error appears in the above-identified patent and that said Letters Patent is hereby corrected as shown below:

Title page,
Item [75], Inventors, should read:

-- [75] Inventors: Masayasu Fujii, Yokkaichi-City, Japan
Hitoshi Okumura, Yokkaichi-City, Japan --

Signed and Sealed this

Twenty-third Day of November, 2004

JON W. DUDAS
*Director of the United States Patent and Trademark Office*